United States Patent [19]

Sear et al.

[11] 4,430,780

[45] Feb. 14, 1984

[54] FLUID FLOW COMINGLING JET

[75] Inventors: Stuart B. Sear, Lewisville; Christopher A. Hill, King, both of N.C.

[73] Assignee: International Machinery Sales, Inc., Winston-Salem, N.C.

[21] Appl. No.: 338,570

[22] Filed: Jan. 11, 1982

[51] Int. Cl.[3] ..... D02G 1/16

[52] U.S. Cl. ..... 28/272; 28/274

[58] Field of Search ..... 28/271, 272, 273, 274, 28/275, 276, 252; 57/350

[56] References Cited

U.S. PATENT DOCUMENTS

| | | | |
|---|---|---|---|
| 2,783,609 | 3/1957 | Breen | 57/140 |
| 2,884,756 | 5/1959 | Head | 57/34 |
| 3,079,745 | 3/1963 | Breen et al. | 28/276 X |
| 3,125,793 | 3/1964 | Gonsalves | 28/1 |
| 3,353,344 | 11/1967 | Wendening, Jr. | 28/272 X |
| 3,448,501 | 6/1969 | Buzano | 28/72 |
| 3,458,987 | 8/1969 | Ozawa et al. | 47/140 |
| 3,473,315 | 10/1969 | Le Noir | 57/140 |
| 3,545,057 | 12/1970 | Lubach | 28/1.4 |
| 3,724,040 | 4/1973 | Ohayon | 28/276 |
| 3,750,242 | 8/1973 | Lloyd et al. | 28/274 X |
| 3,823,450 | 7/1974 | Ankudowicz et al. | 28/272 |
| 3,970,231 | 7/1976 | Strutz et al. | 28/272 X |
| 4,004,329 | 1/1977 | London, Jr. et al. | 28/274 |
| 4,069,565 | 1/1978 | Negishi et al. | 28/274 |
| 4,104,770 | 8/1978 | Massey, Jr. et al. | 28/257 |
| 4,155,216 | 5/1979 | Griset, Jr. | 28/252 X |
| 4,251,904 | 2/1981 | Sano et al. | 28/274 |
| 4,253,299 | 3/1981 | Borenstein et al. | 28/272 X |

FOREIGN PATENT DOCUMENTS

| | | | |
|---|---|---|---|
| 1048002 | 11/1966 | United Kingdom | 29/272 |
| 1204676 | 9/1970 | United Kingdom | 28/274 |

*Primary Examiner*—Robert Mackey

*Attorney, Agent, or Firm*—Grover M. Myers

[57] ABSTRACT

A comingling jet having a body or housing through which a right cylindrical yarn chamber extends and an air entry orifice which intersects and communicates with the yarn chamber so that their axis are perpendicular to one another. An adjustable pin assembly is provided at the entry opening of the yarn chamber to modify the air flow characteristics of the yarn chamber.

1 Claim, 11 Drawing Figures

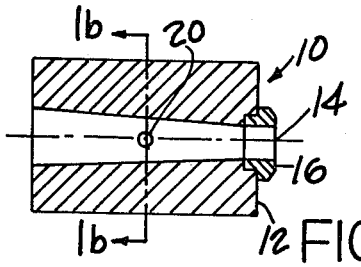
FIG 1a
PRIOR ART
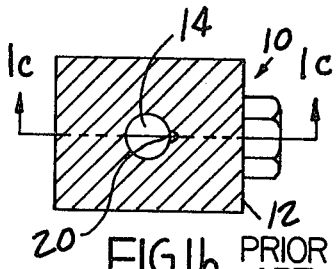
FIG 1b PRIOR ART
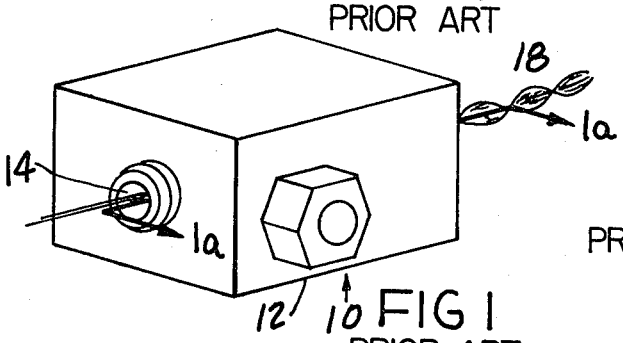
FIG 1
PRIOR ART
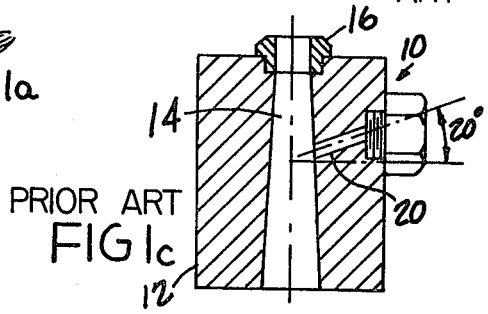
PRIOR ART
FIG 1c
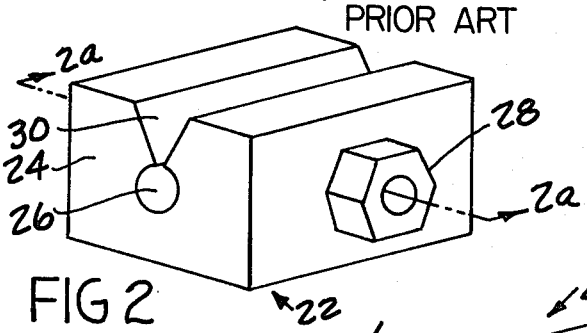
FIG 2
PRIOR ART
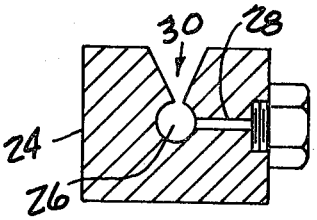
FIG 2a PRIOR ART
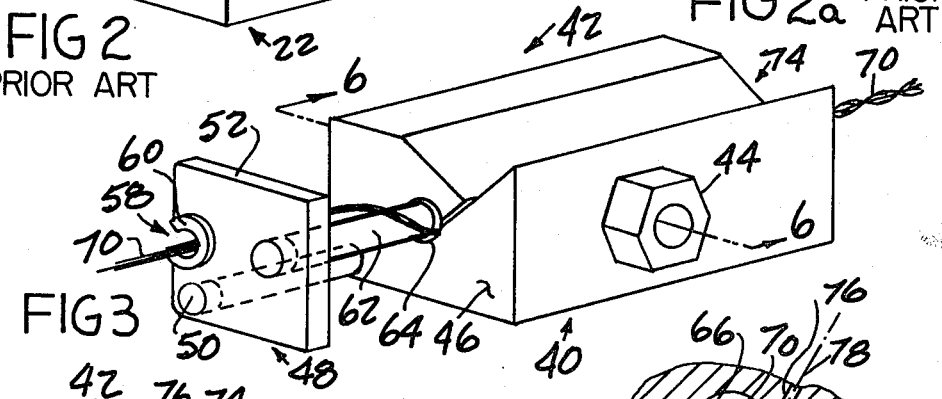
FIG 3
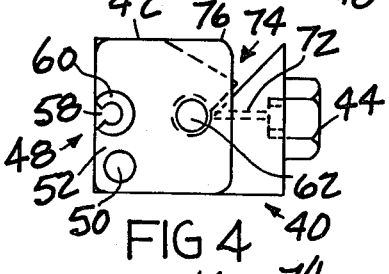
FIG 4
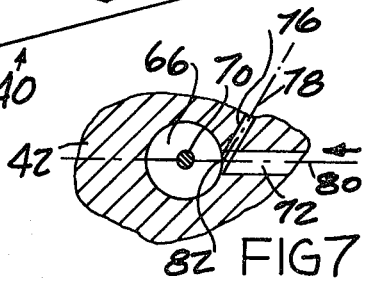
FIG 7
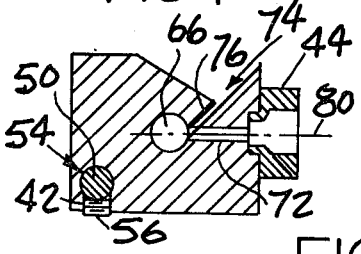
FIG 6
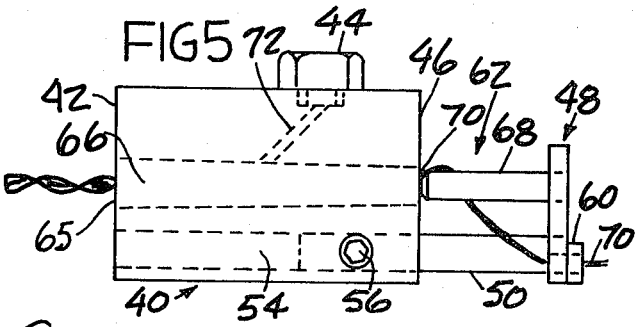

FLUID FLOW COMINGLING JET

BACKGROUND OF THE INVENTION

This invention relates to a fluid jet which uses turbulent flow to comingle yarn filaments to texturize the yarn for knitting and weaving operations in the textile industry, and more particularly, to a comingling forwarding jet which can be easily laced.

In the textile industry, turbulent flow comingling jets are sometimes known as intertangling or interlacing jets and are used to entangle yarn by intertwining multifilament, artificial threads and avoid the process of twisting. When comingled, the yarn has an undulating appearance with tight areas known as knots or nodes spaced by fluffy areas of entangled filaments. A single strand having a multitude of filaments or a plurality of strands ranging from 40–800 denier can be directed through a single jet at the same time. There are many different types of jets used today, for example, closed jets, forwarding jets and slotted jets, all of which have a yarn chamber extending the length of the jet body which accommodate various sizes of yarn and an air entry orifice which is used to direct an air flow into the yarn chamber to cause the comingling of the filaments.

The closed jet is generally the simplest in design and generally includes a body having a right cylindrical yarn chamber extending therethrough and an air entry orifice for introducing high pressure air into the chamber. The air entry orifice is normally perpendicular to the axis of the cylindrical yarn chamber. Although this type of jet is still in use today and can be used quite successfully since it is the most efficient with respect to use of air and comingling effect, it is not very versatile and must be size to a particular situation so that it can only be used with a narrow range of deniers and machine speeds. These limitations require that each time the denier or machine speed exceeds the ranges, the jet must be changed. The present invention overcomes this problem by permitting a single jet to be used with a wide range of deniers and machine speeds.

Having to lace a jet from one end to the other can produce a number of problems simply because many of the jet are located on the textile machines in areas which are difficult to access. The closed jet is usually located where there is a static lacing condition since it requires the operator to lace the thread through the yarn chamber but there are many situations where a closed fluid jet is unsuitable. Therefore, a slot jet has been developed to overcome these lacing problems. Most slot jets have a narrow, longitudinal slot extending the length of the jet body and communicating with the yarn chamber so the operator can access the yarn chamber through the slot rather than threading the yarn chamber from one end to the other. The basic problem with the slot jet is that it uses greater amounts of air and the yarn has a tendency to escape from the jet when a small finish build-up exists in the yarn chamber. Most slots are located to access the yarn chamber at 90° to the air entry orifice and will reduce the efficiency of the chamber irrespective of the slot width.

It is believed that the comingling jet works in the following manner to form knots or nodes and texturize the yarn. As the yarn is directed through the yarn chamber, the pressurized air enters the chamber through the air entry orifice. Upper and lower vortexes rotating in opposite directions are formed on opposite sides of the yarn chamber centerline. In a non-forwarding jet, the vortexes direct an equal amount of air out the entry and exit end of the yarn chamber. It is also believed that the vortexes terminate at planes which are contiguous to the ends of the yarn chamber, and that the knots are formed at these termination planes. As the yarn travels through the yarn chamber, it viberates rapidly between the upper and lower vortexes with the yarns rotation depending on which vortex the yarn is entrained. The intensity of the knots is the function of the speed of rotation of the vortex which, in turn, depends upon the air pressure and the chamber configuration. The air entry orifice should be located so that its centerline intersects the centerline of the yarn chamber. If the centerlines do not intersect, one of the vortexes may be predominant and the yarn will be retained in the predominant vortex, and be twisted in one direction with no comingling.

In recent years, the industry has produced a jet which will more efficiently forward the yarn through the chamber. Basically, the forwarding jet is designed so that the vortexes at the exit end of the jet are stronger than the vortexes at the entry end of the jet. This can be accomplished by various techniques; for example, by angling the air entry orifice, by tapering the yarn chamber from the entry to the exit end or by cutting away a section of the body to produce a vent. Furthermore, these techniques can be used in combination to maximize the forwarding effect as a more efficient forwarding action is required at speeds increasing to 800 m/m. The present invention provides a new technique to produce an increased forwarding action.

Although most of the forwarding comingling jets used today are the closed chamber (i.e., no slot) type and, therefore, have no automatic threading capability, there is a forwarding slot jet on the market today. This jet has a variety of forwarding features such as a tapered chamber, angular air entry orifice and a vent. However, none of these presently used jets can satisfy a wide range of yarn descriptions and denier. Also, a jet configuration which works with one type yarn on one machine may not work on the same machine for a different yarn description or may work entirely different on another type processing machine. It has been observed that, the greater the forwarding capacity of the jet, the less comingling action, and no matter how much forwarding is required, compacting of the yarn filiaments is the primary objective of the comingling process. Another disadvantage of the forwarding jets which are of a fixed design, and thus have fixed flow characteristics, is that there is a narrow range of machine speeds.

By varying the slot, conical chamber and angle of the entry orifice, there can be an infinite number of jets, but, again, they are limited to short ranges of applications. It is, therefore, apparent that there is a need for a comingling jet for use in the textile industry which can be used with a greater range of denier sizes and varying machine speeds and can be easily laced.

SUMMARY OF THE INVENTION

It is, therefore, an object of this invention to provide a yarn comingling system which can accommodate a wide range of denier sizes.

Another object of this invention is to provide a comingling jet which will permit wider range of machine speeds and still obtain adequate comingling.

Another object of this invention is to provide a comingling jet which can be used in a multitude of locations on a texturizing machine and perform a variety of functions where heretofore only specialized jets could be used.

Still another object of this invention is to provide an easily laced jet which utilizes less air than the presently known slot jet.

Still another object of this invention is to provide a forwarding jet which can be easily laced while retaining the comingling efficiency of a closed jet.

These and other objects and benefits are accomplished by the present invention through the use of a comingling jet having a body or housing through which a right cylindrical yarn chamber extends. An air entry orifice intersects and communicates with the yarn chamber so that their axis are perpendicular to one another. An adjustable pin assembly is provided at the entry opening of the yarn chamber to modify the air flow characteristics of the yarn chamber.

BRIEF DESCRIPTION OF THE DRAWINGS

The foregoing and additional objects, features and advantages of the present invention will be apparent to those skilled in the art from the following detailed description of a preferred embodiment, taken with the accompanying drawings in which:

FIG. 1 is a perspective of a standard closed forwarding jet known in the prior art having a tapered yarn chamber and an angled air entry orifice;

FIG. 1*a* is a cross section taken along Line 1*a*—1*a* of FIG. 1;

FIG. 1*b* is a cross section taken along Line 1*b*—1*b* of FIG. 1*a;*

FIG. 1*c* is a cross section taken along Line 1*c*—1*c* of FIG. 1*b.*

FIG. 2 is a perspective of a standard slot jet known in the prior art;

FIG. 2*a* is a cross section taken along Line 2*a*—2*a* of FIG. 2;

FIG. 3 is a perspective of an adjustable forwarding slot comingling jet according to the present invention;

FIG. 4 is a front elevation view of the comingling jet shown in FIG. 3;

FIG. 5 is a bottom view of the comingling jet shown in FIG. 3;

FIG. 6 is a cross section taken along Line 6 of FIG. 3; and

FIG. 7 is an enlarged detailed of the intersection of the yarn chamber, air entry orifice and the slanted slot according to the present invention.

DESCRIPTION OF THE PRIOR ART

In FIGS. 1, 1*a* through 1*c*, the numeral 10 indicates a closed comingling jet having a solid body or housing 12 which is normally made of stainless steel although other materials can be used. A yarn chamber 14 extends through the body 12 and, if desired, can have ceramic inserts 16 (see FIGS. 1*a* and 1*c*). In the simplest form of the closed comingling jet (not shown), the yarn chamber is a right cylinder bore and the air entry orifice extends through the body of the jet and its centerline is perpendicular to and intersects the centerlne of the yarn chamber 14. This type of configuration produces good vortexes and, thus, produces tight nodes 18. The closed jet also uses the least amount of air and is commonly used at points in a machine at static threading situation.

The closed jet illustrated in FIG. 1 has two forwarding features which are presently used in the industry. The yarn chamber 14 has been tapered from the entrance end to the exit end at a taper of approximately ¼ per foot. As explained earlier, this causes the air to flow in the direction in which the thread line is moving. The other feature is the angled air entrance orifice 20 which normally is angled at 20° from the perpendicular in the direction of the entrance end of the jet (see FIG. 1*c*).

FIG. 2 illustrates a slot jet 22 having a body 24 with a right cylinder yarn chamber 26 extending through the body. The entry orifice 28 extends through the body and intersects the yarn chamber 26. A slot 30 extends the length of the body and communicates with the yarn chamber 90° from the centerline of the air entrance orifice. The slot permits the jet to be threaded automatically and the position of the slot at 90° to the air entry orifice prevents the yarn from being blown out of the chamber during machine operation providing the chamber is free of excess monomer and finish buildup.

DESCRIPTION OF A PREFERRED EMBODIMENT

As explained above, there are a variety of problems which exist with the presently used comingling jets which the adjustable forwarding slot jet overcomes. As illustrated in FIGS. 3–6, the numeral 40 indicates a comingling jet according to the present invention having a body or housing 42 with an air entry fitting 44 suitably secured in its side by threading or welding. The commingling jet has a yarn chamber 66 extending therethrough with entrance and exit openings, 64 and 65, respectively.

Attached to the entrance end 46 of the body is a pin assembly 48. The pin assembly 48 has a securing shaft 50 rigidly connected to a plate 52 and is inserted into a bore 54 (see FIGS. 5 and 6) extending through the body 42. The shaft is held in the appropriate position by a set screw 56 or other suitable means.

It should be understood that the above-described method of adjusting the position of the pin assembly 48 is the simplest available, but other methods which permit a uniform adjustment or a selected pin position can easily be substituted and are known in the art.

The plate 52 has a yarn guide 58 with a ceramic insert 60. A portion of the guide is cut away to permit easy threading of the guide. The plate 52 carries a fluid flow modifying pin 62 which extends towards the jet body 42 and into the entrance opening 64 of the jet yarn chamber 66. The pin body 68 is normally the size of the entrance opening 64 of the yarn chamber and has a round shape but it can be other shapes. The head 70 (see FIG. 5) of the pin is usually smaller so that it can be inserted into the yarn chamber to form an annular space between the head 70 and the entrance opening 64. The head can vary in configuration from a rounded embodiment to a pointed embodiment. As can be easily understood, the position of the pin head within the yarn chamber will change the flow characteristics of the jet and produce a forwarding action. The forwarding action of the jet as well as the size and the number of yarn threads which can be used within the jet can be varied by simply varying the position of the pin.

This is extremely important in the textile industry since most of the jets used today are very limited in yarn size range and have a fixed forwarding action.

The yarn chamber 66 can be a right cylinder bore or it can be tapered as shown in FIG. 5 to provide additional forwarding action, if desired. More forwarding action can be provided by angling the air entry orifice 72 as discussed earlier. However, it has been found than an angle of only 5° rather than 20° will satisfy most situations. Forwarding jets are required when the machine speeds are from 700 to 1,000 m/m.

Although not specifically related to the forwarding aspects of the adjustable comingling jet 40 since such a jet would operate as a closed jet, an additional feature of the jet illustrated in FIG. 3 is the slot which produces the multipurpose aspects of the design. This slot design results in a better utilization of air and prevents the yarn from being blown out of the yarn chamber. The top surface of the jet body 40 has a cut-out portion 74 in the form of a V-trough (see FIGS. 6 and 7). At the apex of the V-trough is a slot 76 which extends the length of the jet body to permit easy threading of the yarn 70 into the yarn chamber 66. Preferably, the centerline 78 of the slot 76 intersects the centerline 80 of the air entry orifice 72 at the circumference or bore surface 82 of the yarn chamber 66 (see FIG. 7); however, it has been found that as long as the slot centerline intersects the yarn chamber surface at or below the air entry orifice centerline, the jet operates properly.

It has been found that an adjustable, forwarding slot comingling jet as described above produces a multipurpose jet which can be used with a wide range of denier sizes and machine speeds and can be used in a multiplicity of locations on the texturizing machines. These jets also use less air than presently known slot jets while retaining the efficiency of the closed jets.

We claim:

1. A forwarding commingling jet for use in commingling filaments of yarn having varying deniers, said jet having a body with a yarn chamber extending therethrough with entrance and exit openings at each end of the jet body, an air entry orifice intersecting said yarn chamber, the improvement comprising:

(a) pin means having its head positioned near the entrance opening of said yarn chamber to form an annular space so that filaments moving through the jet pass around the pin means through the annular space formed between the head of the pin means and the entrance opening;

(b) means for selectively adjusting the position of the pin means so that the position of the head of the pin means with respect to the entrance opening can be adjusted to vary the flow and forwarding characteristics of the jet; and (c) an access slot extending the length of the jet body and communicating with the yarn chamber to permit the jet to be threaded.

* * * * *